US007350664B2

(12) United States Patent
Nam et al.

(10) Patent No.: US 7,350,664 B2
(45) **Date of Patent: *Apr. 1, 2008**

(54) HINGE DEVICE FOR STORAGE CONTAINER AND STORAGE CONTAINER HAVING THE SAME

(75) Inventors: Jeong Man Nam, Kwangju (KR); Yong Myoung Kim, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 585 days.

This patent is subject to a terminal disclaimer.

(21) Appl. No.: 10/793,239

(22) Filed: Mar. 5, 2004

(65) Prior Publication Data

US 2004/0256390 A1 Dec. 23, 2004

(30) Foreign Application Priority Data

Jun. 19, 2003 (KR) ..... 10-2003-0039757

(51) Int. Cl.
*B65D 43/26* (2006.01)

(52) U.S. Cl. ..... 220/264; 220/263; 220/262; 220/829; 220/830; 220/845

(58) Field of Classification Search ..... 220/264, 220/262, 263, 829, 830, 845
See application file for complete search history.

(56) References Cited

U.S. PATENT DOCUMENTS 3,930,594 A * 1/1976 Jungmann ..... 220/830
4,701,977 A 10/1987 Hori et al.
4,760,621 A * 8/1988 Stromquist ..... 16/85
5,109,571 A * 5/1992 Ohshima et al. ..... 16/307
5,257,310 A 10/1993 Takagi et al.
5,500,982 A 3/1996 Hosoi (Continued)

FOREIGN PATENT DOCUMENTS

CN 1400150 3/2003

(Continued)

OTHER PUBLICATIONS

The Chinese Office Action for the Chinese Application 200410006828.4 dated Sep. 8, 2006.

(Continued)

*Primary Examiner*—Anthony Stashick
*Assistant Examiner*—Christopher McKinley
(74) *Attorney, Agent, or Firm*—Staas & Halsey LLP

(57) ABSTRACT

A hinge device for a storage containerand includes a housing mounted on any one of the door and a container body, a pair of hinge shafts rotatably fit in respective ends of the housing, each of the pair of hinge shaft including a cam shaft part with a first cam provided on an outer circumferential surface thereof, and an extension shaft part outwardly extending from the cam shaft part to couple to a remaining one of the door and the container body, a pair of movable members, which are received in respective ends of the housing and fit on the cam shaft parts of the respective hinge shafts, each of the pair of movable members having a second cam to engage with the respective first cam, and a pair of compression springs disposed in ends of the housing to bias the pair of movable members toward the pair of first cams, respectively.

30 Claims, 13 Drawing Sheets

U.S. PATENT DOCUMENTS

| | | | | |
|---|---|---|---|---|
| 5,651,063 | A | 7/1997 | Ji et al. | |
| 5,715,575 | A | 2/1998 | Kubota | |
| 5,774,939 | A | 7/1998 | Lu | |
| 5,918,348 | A | 7/1999 | Carpenter et al. | |
| 6,035,491 | A | 3/2000 | Hartigan et al. | |
| 6,070,298 | A * | 6/2000 | Sorimachi | 16/330 |
| 6,119,310 | A | 9/2000 | Ohshima et al. | |
| 6,209,173 | B1 | 4/2001 | Salter et al. | |
| 6,453,804 | B1 | 9/2002 | Lee | |
| 6,615,607 | B1 * | 9/2003 | Lee | 62/440 |
| 6,772,481 | B2 * | 8/2004 | Oshima et al. | 16/330 |
| 6,817,064 | B2 * | 11/2004 | Kim et al. | 16/335 |
| 7,040,113 | B2 * | 5/2006 | Lee et al. | 62/407 |
| 2002/0092853 | A1 * | 7/2002 | Wang | 220/263 |
| 2002/0194861 | A1 * | 12/2002 | Shin | 62/440 |
| 2003/0000955 | A1 * | 1/2003 | Lee | 220/830 |
| 2003/0005548 | A1 * | 1/2003 | Kim et al. | 16/296 |
| 2003/0019873 | A1 * | 1/2003 | Nam et al. | 220/524 |
| 2003/0173369 | A1 * | 9/2003 | Nikolaus et al. | 220/830 |
| 2003/0201265 | A1 * | 10/2003 | Lin | 220/254.3 |
| 2004/0177641 | A1 * | 9/2004 | Kim | 62/441 |
| 2004/0250565 | A1 * | 12/2004 | Lee et al. | 62/407 |
| 2004/0256390 | A1 * | 12/2004 | Nam et al. | 220/264 |

FOREIGN PATENT DOCUMENTS

| | | |
|---|---|---|
| JP | 7-159020 | 6/1995 |
| JP | 8-247134 | 9/1996 |
| JP | 9-217731 | 8/1997 |
| JP | 11-230155 | 8/1999 |
| JP | 2000-22790 | 1/2000 |
| JP | 2000-192939 | 7/2000 |
| JP | 2001-185868 | 7/2001 |
| JP | 2001-193728 | 7/2001 |
| JP | 2001-288958 | 10/2001 |
| JP | 2001-295829 | 10/2001 |

OTHER PUBLICATIONS

Japanese Patent Office Action, dated Dec. 19, 2006, and issued in Japanese Patent Application No. 2002-169123.

Korean Patent Abstracts for Publication No. 1020010028642, dated Apr. 6, 2001.

Korean Patent Abstracts for Publication No. 1020010017797, dated Mar. 5, 2001.

* cited by examiner

HINGE DEVICE FOR STORAGE CONTAINER AND STORAGE CONTAINER HAVING THE SAME

CROSS-REFERENCE TO RELATED APPLICATION

This application claims the benefit of Korean Application No. 2003-39757, filed Jun. 19, 2003, in the Korean Intellectual Property Office, the disclosure of which is incorporated herein by reference.

BACKGROUND OF THE INVENTION

1. Field of the Invention

The present invention relates to a hinge device for a storage container and a storage container including the hinge device, and, more particularly, to a hinge device for a storage container, which is easily mounted on the storage container and enables a door of the storage container to be smoothly closed, and a storage container including the hinge device.

2. Description of the Related Art

Generally, there is known a typical kimchi storage container, as a top opening-type storage container, which has a top cover attached to a container body and is adapted to swingably open and close on the container body. The kimchi storage container includes the container body including a receptacle chamber defined therein, with a top thereof being opened, a door to close the top opening of the receptacle chamber, and a hinge device to swingably couple the door to the container body and to allow the door to swingably open and close.

Korean Registered Utility Model Publication No. 20-0298042 discloses a conventional hinge device for a kimchi storage container. The conventional hinge device includes a cylindrical housing mounted on a top of a container body to couple a rear end of a door to the container body. The cylindrical housing includes a pair of hinge units received in respective ends thereof, and shafts outwardly extending from the pair of hinge units and fitting in respective ends of the rear end of the door, so as to allow the rear end of the door to swingably couple to the container body.

In the above-mentioned conventional hinge device for the kimchi storage container, the housing mounted on the container body and the pair of hinge units received in respective ends of the housing are separately manufactured. Accordingly, since a number of components is increased due to a manufacturing of the components being divided, manufacturing costs are increased, and an operation of coupling the door to the container body is complicated and cumbersome.

Further, since the door of the conventional kimchi storage container is relatively heavy, the door tends to close by a weight of the door when a user closes the door. However, since the hinge device does not have sufficient shock-absorbing ability, an impact of the door generates a shock at a time of closing the door.

SUMMARY OF THE INVENTION

Accordingly, it is an aspect of the present invention to provide a hinge device for a storage container and the storage container including the hinge device, in which hinge units are integrated into a single hinge device to reduce a number of components, thereby simplifying an assembly process of the hinge device, and thus reducing manufacturing costs.

It is another aspect to provide a hinge device for a storage container and the storage container including the hinge device, which enables a door to be smoothly closed to prevent a generation of a shock.

Additional aspects and/or advantages of the invention will be set forth in part in the description which follows and, in part, will be obvious from the description, or may be learned by practice of the invention.

The above and/or other aspects are achieved by providing a hinge device for a storage container, which enables a door of the storage container to swingably couple to a container body, the hinge device comprising a housing mounted on any one of the door and the container body, a pair of hinge shafts rotatably fitting in respective ends of the housing, each of the pair of hinge shafts including a cam shaft part with a first cam provided on an outer circumferential surface of the cam shaft part, and an extension shaft part outwardly extending from a respective one of the cam shaft parts to be coupled to a remaining one of the door and the container body, a pair of movable members, which are received in the respective ends of the housing and fitting on corresponding ones of the cam shaft parts of the hinge shafts so as not to rotate with respect to the housing, each of the pair of movable members having a second cam to engage with a respective one of the first cam, and a pair of compression springs disposed in the respective ends of the housing to bias the pair of movable members toward a pair of the first cams.

The housing may include a housing body, which is opened at respective ends thereof and receives the pair of movable members and the pair of compression springs in the respective ends thereof, and a pair of plugs coupled to the respective opened ends of the housing body, each of the pair of plugs having a shaft hole, through which an extension shaft part of a corresponding hinge shaft passes.

The housing body may include a guide rail longitudinally provided on an inner surface of the housing body to assure a stable movement of each of the movable members in the housing body while preventing a rotation of each of the movable members, and each of the pair of movable members may include a guide groove corresponding to the guide rail of the housing body.

The first and second cams facing each other may include tooth-shaped cam surfaces corresponding to each other, each of the cam surfaces having an opening-guide surface inclined with respect to an axis of the hinge shaft, so as to cause the hinge shaft to rotate in an opening direction of the door when the door is opened, and a closing-guide surface perpendicular to the axis of the hinge shaft, so as to allow the hinge shaft to rotate in a closing direction of the door by a weight of the door when the door is closed.

The hinge device may further comprise a shock-absorbing unit, which increases a resistance to a rotation of the hinge shaft when the door is closed, the shock-absorbing unit including a protrusion provided on an outer surface of the hinge shaft and disposed in an inner circumferential surface of each of the plugs, and a shock-absorbing spring attached to the inner circumferential surface of each of the plugs and disposed outside of the protrusion, so as to press the protrusion when the door is closed.

The shock-absorbing spring may include an arch leaf spring.

The hinge device may further comprise a shock-absorbing unit, which increases a resistance to a rotation of the hinge shaft when the door is closed, the shock-absorbing unit including a teeth portion provided on an outer surface of the hinge shaft and disposed in an inner circumferential surface of each of the plugs, a gear rotatably held on the inner circumferential surface of each of the plugs, so as to engage with the teeth portion when the door rotates to where the door is almost closed, and a torsion spring disposed on a shaft of the gear to provide the gear with the resistance to the rotation.

Furthermore, the above and/or other aspects are achieved by providing a hinge device for a storage container, which enables a door of the storage container to swingably couple to a container body, the hinge device comprising a housing mounted on any one of the door and the container body, a hinge shaft rotatably fitting at one end thereof in an end of the housing, and outwardly extending at another end thereof from the housing to couple to a remaining one of the door and the container body, and a shock-absorbing unit provided between an inner surface of the housing and an outer surface of the hinge shaft, so as to increase a resistance to a rotation of the hinge shaft when the door is closed.

The above and/or other aspects are achieved by providing a storage container including a container body having a storage chamber with a top thereof being opened, a door to close the container body, and a hinge device to enable the door to swingably couple to the container body, the hinge device comprising a housing mounted on any one of the door and the container body, a pair of hinge shafts rotatably fitting in respective ends of the housing, each of the pair of hinge shaft including a cam shaft part with a first cam provided on an outer circumferential surface a respective one of the cam shaft parts, and an extension shaft part outwardly extending from the respective one of the cam shaft parts to couple to a remaining one of the door and the container body, a pair of movable members, which are received in the respective ends of the housing and fitting on corresponding ones of the cam shaft parts of the hinge shafts so as not to rotate with respect to the housing, each of the pair of movable members having a second cam to engage with a respective one of the first cam, and a pair of compression springs disposed in the respective ends of the housing to bias the pair of movable members toward the pair of first cams.

The above and/or other aspects are achieved by providing a storage container including a container body having a storage chamber with a top thereof being opened, a door to close the container body, and a hinge device to enable the door to swingably couple to the container body, the hinge device comprising a housing mounted on any one of the door and the container body, a hinge shaft rotatably fitting at one end thereof in an end of the housing, and outwardly extending at another end thereof from the housing to couple to the other of the door and the container body, and a shock-absorbing unit provided between an inner surface of the housing and an outer surface of the hinge shaft, so as to increase a resistance to a rotation of the hinge shaft when the door is closed.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
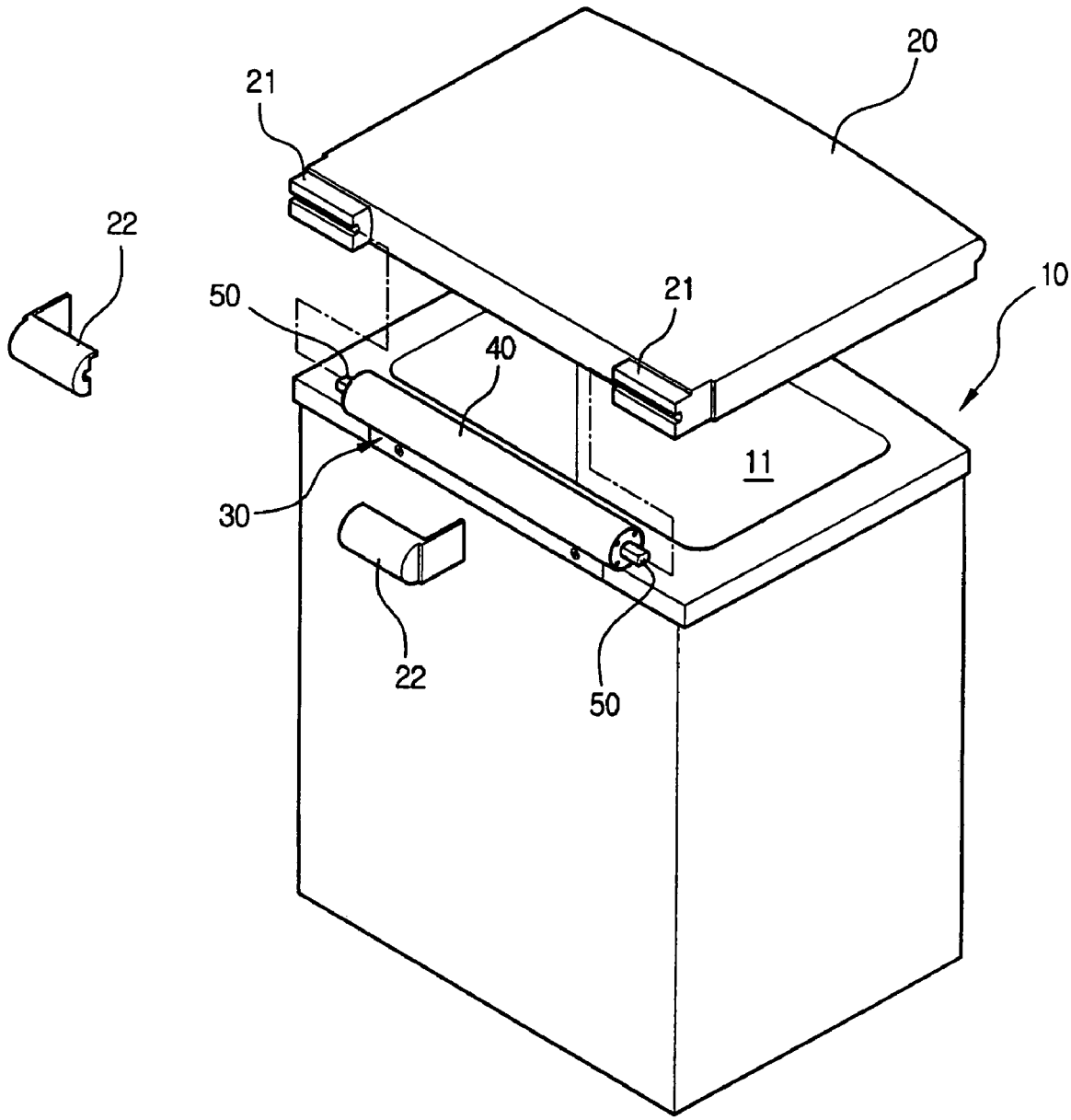
FIG. 1 is an exploded perspective view showing a kimchi storage container including a hinge device, according to an embodiment of the present invention.
Figure 2:
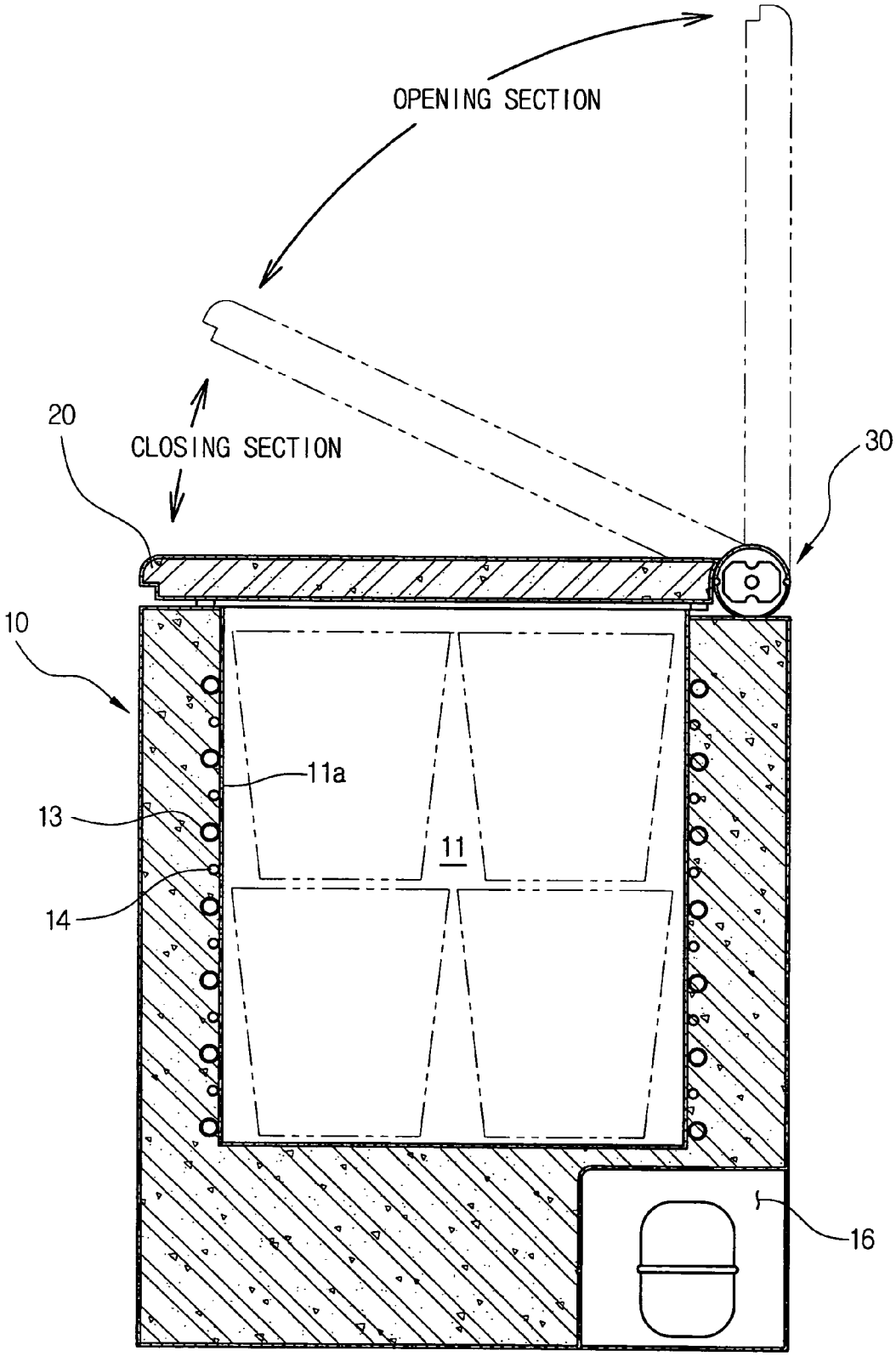
FIG. 2 is a cross-sectional view of the kimchi storage container shown in FIG. 1.

Reference will now be made in detail to the present preferred embodiments of the present invention, examples of which are illustrated in the accompanying drawings, wherein like reference numerals refer to like elements throughout FIG. 1 is an exploded perspective view showing a kimchi storage container including a hinge device 30, according to an embodiment of the present invention, and FIG. 2 is a cross-sectional view of the kimchi storage container shown in FIG. 1.

As shown in FIGS. 1 and 2, the kimchi storage container includes a container body 10 made of a heat insulating material and having a storage chamber 11 with a top thereof being opened, and a door 20 coupled to an upper end of the container body 10 to close the storage chamber 11 of the container body 10. The container body 10 includes an evaporator 13 comprising a refrigeration pipe to cool the storage chamber 11, and a heater 14 comprising a heating element to age kimchi stored in the storage chamber 11, in which both the evaporator 13 and the heater 14 surround an inner wall 11*a* of the storage chamber 11. Furthermore, the container body 10 includes a machine room 16 at a lower portion thereof such that the machine room 16 is isolated from the storage chamber 11, so as to house electrical components such as a compressor 15.

As shown in FIG. 1, the door 20 swingably couples at a rear end thereof to the upper end of the container body 10 by a hinge device 30. The hinge device 30 is fixedly mounted on a rear side of an upper end of the container body 10, and includes a pair of rotatable hinge shafts 50 at respective ends thereof. The door 20 includes a pair of fitting members 21 provided at respective sides of a rear end of the door 20, and a pair of corresponding cover members 22 couple to the pair of fitting members 21, respectively, so as to allow the rotatable hinge shafts 50 to be disposed between the respective fitting members 21 and the respective cover members 22. That is, since both of the hinge shafts 50 of the hinge device 30 are fitted between the respective fitting members 21 and the respective cover members 22, the door 20 swingably couples to the container body 10.

Figure 3:
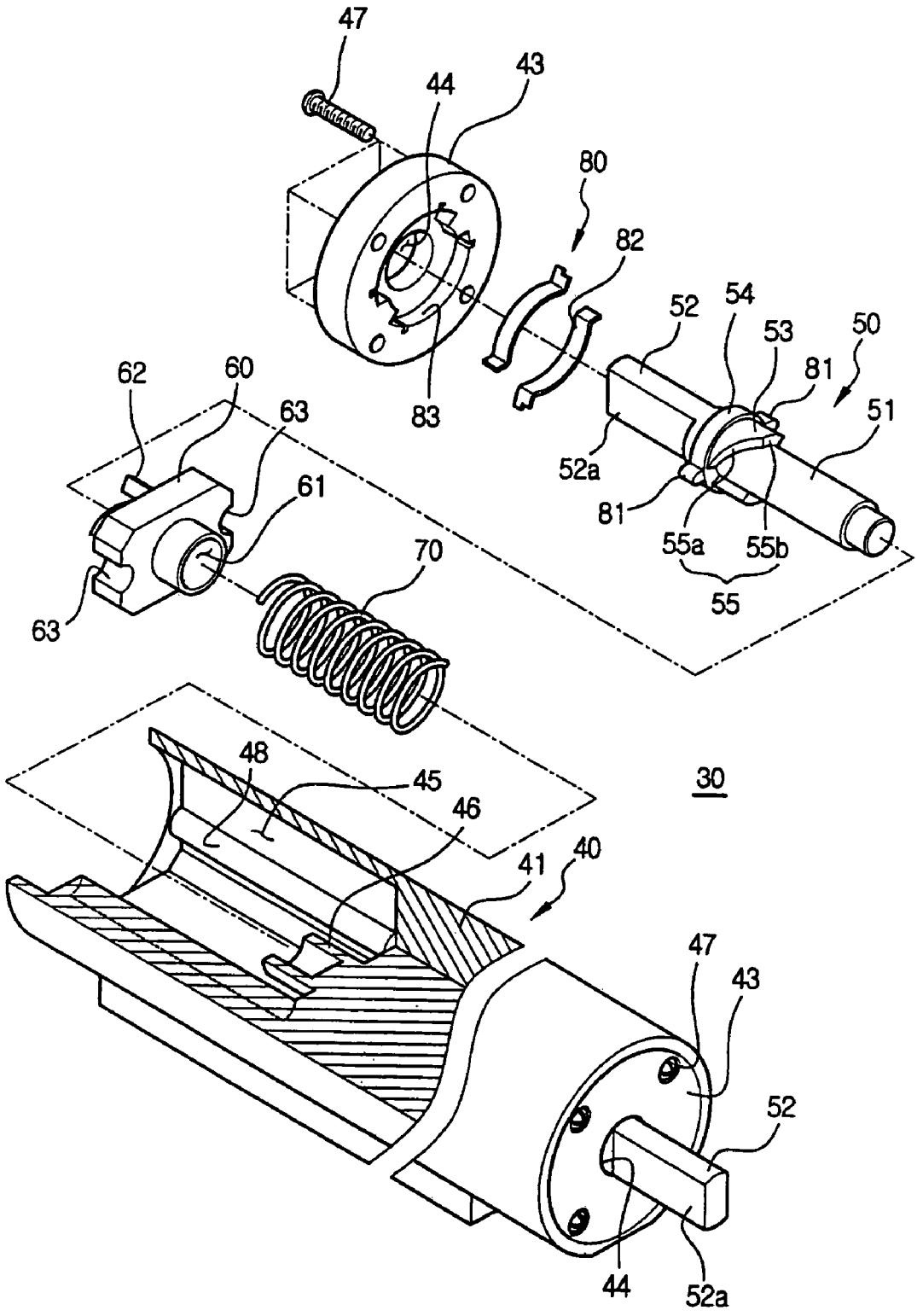
FIG. 3 is an exploded perspective view of a hinge device for a storage container, according to an embodiment of the present invention.
Figure 4:
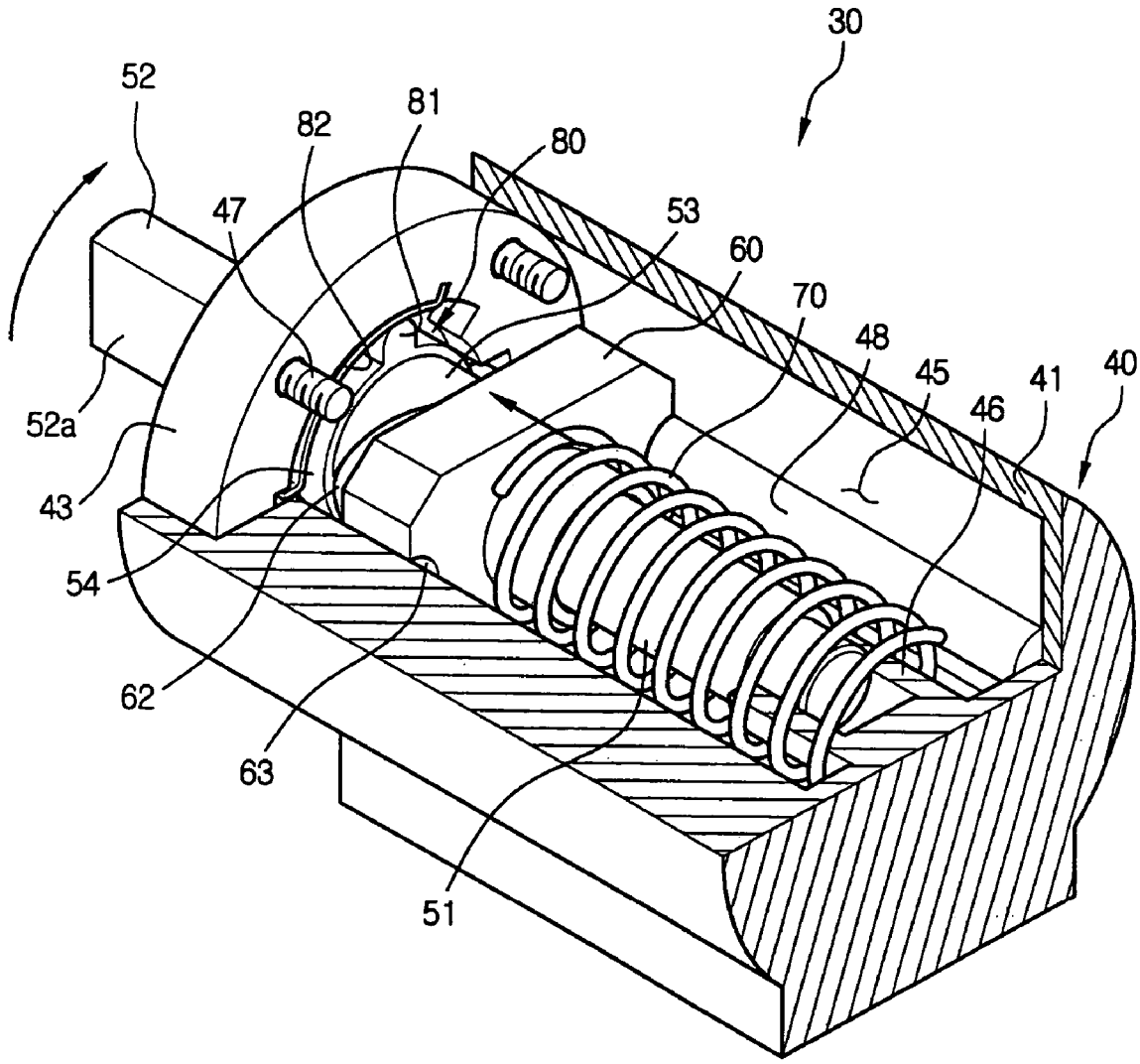
FIG. 4 is a perspective view, which is partially broken away, of the assembled hinge device shown in FIG. 3 when opening a door.

As shown in FIGS. 3 and 4, the hinge device 30 for a kimchi storage container, according to an embodiment of the present invention, includes the pair of rotatable hinge shafts 50 rotatably coupled to respective ends of a housing 40 mounted on an upper end of the container body 10, each of the pair of rotatable hinge shafts 50 having a first cam 53, and a pair of movable members 60 received in the housing 40 to longitudinally move, each of the pair of movable members 60 having a second cam 62 engaging with the first cam 53. The hinge device 30 further includes compression springs 70 to bias the movable members 60 toward the first cams 53, and shock-absorbing units 80 to resist a rotation of the respective rotatable hinge shafts 50 to allow the door 20 to be smoothly closed. In the hinge device 30, the rotatable hinge shafts 50, the movable members 60, the compression springs 70 and the shock-absorbing units 80 are provided at respective ends of the housing 40 such that one rotatable hinge shaft 50, one movable member 60, one compression spring 70 and one shock-absorbing unit 80 are placed at each of the respective ends of the housing 40. That is, the rotatable hinge shafts 50, the movable members 60, the compression springs 70 and the shock-absorbing units 80 are symmetrically provided at respective ends of the housing 40. Accordingly, the hinge device 30 having rotatable hinge shafts 50 at respective ends thereof, may be constructed into a single unit, and thus a number of components is reduced, thereby reducing manufacturing costs. Furthermore, since an assembly process of the hinge device 30 is simplified due to a decreased number of the components, the door 20 can be easily and efficiently coupled to the container body 10.

The housing 40 includes a housing body 41 having two reception spaces 45 at respective ends thereof, and two plugs 43 fitting in the respective openings of the housing body 41 to close the reception spaces 45. Each of the two reception spaces 45 receives one of the rotatable hinge shafts 50, one of the movable members 60 and one of the compression springs 70, and is opened at an outer end thereof. Each of the two plugs 43 is formed with a shaft hole 44 through which one of the hinge shafts 50 passes. Each of the reception spaces 45 has a substantially rectangular section to permit the respective movable member 60 to longitudinally move in the reception space 45 while preventing a rotation of the movable member 60.

The housing body 41 includes two internal support pipes 46 at inner ends of the two reception spaces 45, so as to support inner ends of the rotatable hinge shafts 50 and the two compression springs 70 while permitting the rotatable hinge shafts 50 to rotate. The two plugs 43 are joined to respective ends of the housing body 41 by a plurality of set screws 47.

Each of the rotatable hinge shafts 50 includes a cam shaft part 51 received in the housing body 41 of the housing 40 and including the first cams 53, and an extension shaft part 52 integrally formed with the cam shaft part 51 and outwardly extends from the housing 40 through the shaft hole 44 of the plug 43 by a predetermined distance. The cam shaft part 51 includes a support flange 54 at an outer end thereof adjacent to the first cam 53. The cam shaft part 51 of the rotatable hinge shaft 50 is rotatably supported at an inner end thereof by the internal support pipe 46, and is further supported at the support flange 54 thereof by an inner side surface of the plug 43, thereby preventing a longitudinal movement of the hinge rotatable shaft 50. The extension shaft part 52 of the rotatable hinge shaft 50 includes flat surfaces 52*a* formed at diametrically opposite sides of an outer circumferential surface thereof so as to allow the extension shaft part 52 to couple to the door 20 without a relative rotation with respect to the door 20.

Figure 6:
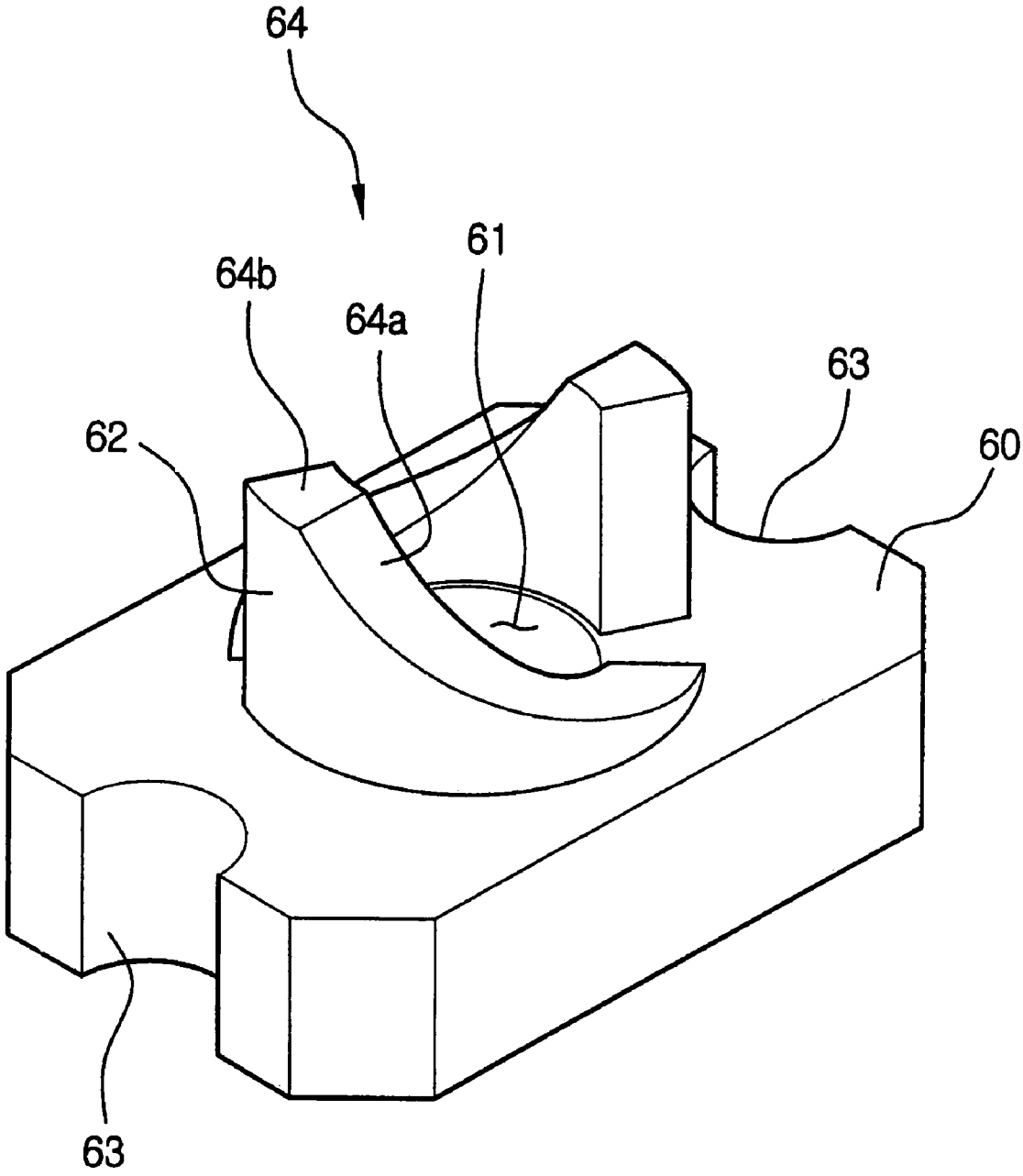
FIG. 6 is a perspective view of a movable member of the hinge device shown in FIG. 3.

As shown in FIGS. 3 and 6, each of the movable members 60 is shaped to have a contour corresponding to a rectangular section of the reception space 45 of the housing body 41, so as to permit the movable member 60 to move along the reception space 45. Furthermore, the movable member 60 includes a central through-hole 61, so as to allow the cam shaft part 51 of the rotatable hinge shaft 50 to pass therethrough. The housing body 41 of the housing 40 includes a pair of longitudinal guide rails 48 protruding from an inner surface of the housing body 41 to allow the movable member 60 to freely move along the guide rails 48 without rotating. The movable member 60 further includes a pair of guide grooves 63 corresponding to the guide rails 48.

The second cam 62 is provided on an outer side surface of the movable member 60 facing the first cam 53, so as to cause the rotatable hinge shaft 50 to rotate by a linear movement of the movable member 60. The compression spring 70 fits on the cam shaft part 51 of the rotatable hinge shaft 50 received in the housing 40 to bias the movable member 60 toward the first cam 53. Consequently, a cam surface 64 of the second cam 62 of the movable member 60 normally engages with a cam surface 55 of the first cam 53 of the cam shaft part 51, and is forcibly pressed thereby.

Figure 7:
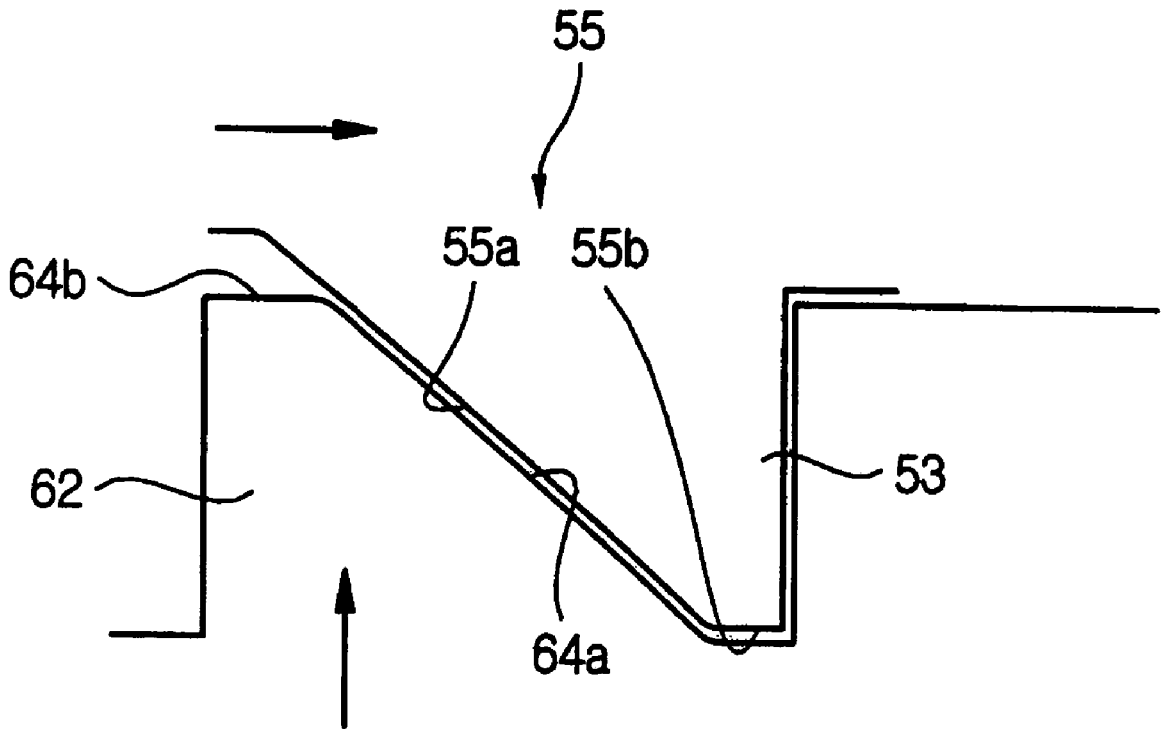
FIG. 7 is a schematic view showing first and second cams of the hinge device shown in FIG. 3, when the door is opened.
Figure 8:
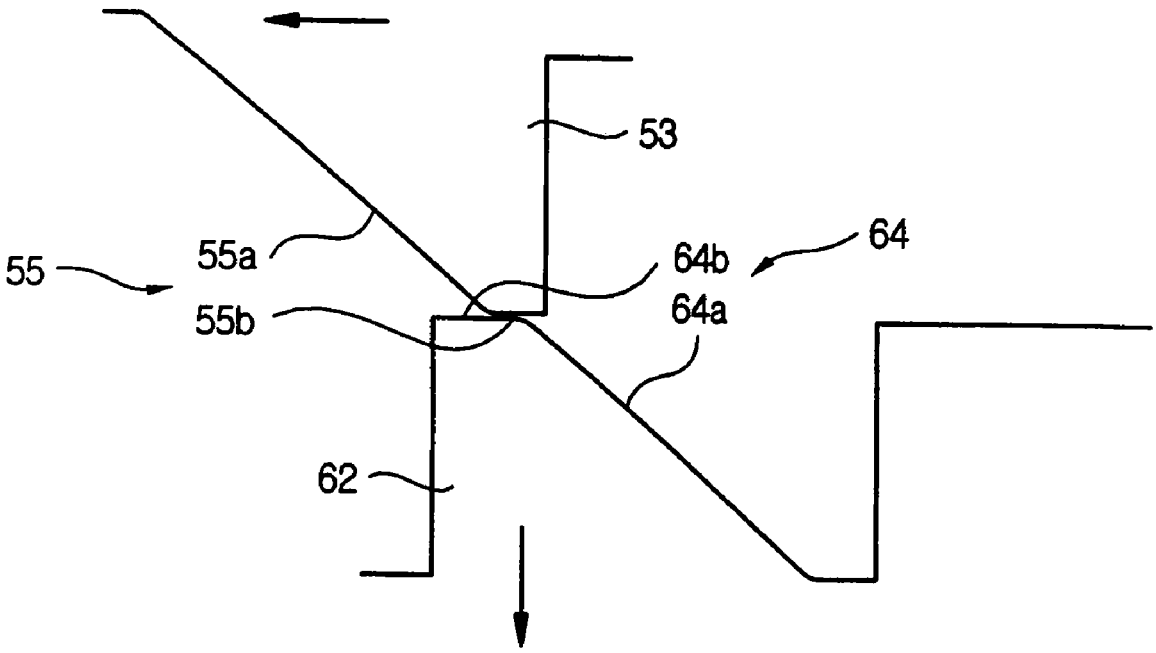
FIG. 8 is a schematic view showing first and second cams of the hinge device shown in FIG. 3, when the door is closed.

As shown in FIGS. 6 through 8, the cam surface 55 of the first cam 53 and the cam surface 64 of the second cam 62 are shaped into mating sawteeth forms, which are engaged with each other. The cam surface 55 of the first cam 53 includes inclined opening-guide surfaces 55*a* formed over predetermined sections thereof, and the cam surface 64 of the second cam 62 includes inclined opening-guide surfaces 64*a* formed over predetermined sections thereof. Accordingly, when the door 20 is opened by a predetermined angle or more than the predetermined angle, the rotatable hinge shaft 50 fitting in the door 20 is forced to rotate in a direction of an opening of the door 20, by an elasticity of the compression spring 70. That is, since the rotatable hinge shaft 50 is subjected to a force tending to rotate the door 20 in an opening direction in response to the door 20 being opened by the predetermined angle or more than the predetermined angle, the door 20 is not closed even by a weight thereof, but is maintained in an opened position.

Furthermore, the cam surfaces 55 and 64 of the first and second cams 53 and 62 include closing-guide surfaces 55*b* and 64*b*, respectively, which are formed over predetermined sections of the cam surfaces 55 and 64 perpendicular to an axis of the rotatable hinge shaft 50, so that the door 20 is closed by the weight of the door when the door 20 is opened by the predetermined angle or less than the predetermined angle. Accordingly, even though the movable member 60 is subjected to the elasticity of the compression spring 70 while the closing-guide surfaces 55*b* of the first cam 53 engages with the closing-guide surfaces 64*b* of the second cam 62, the rotatable hinge shaft 50 is not affected by the elasticity of the compression spring 70, thereby allowing the door 20 to close by the weight thereof.

Figure 9:
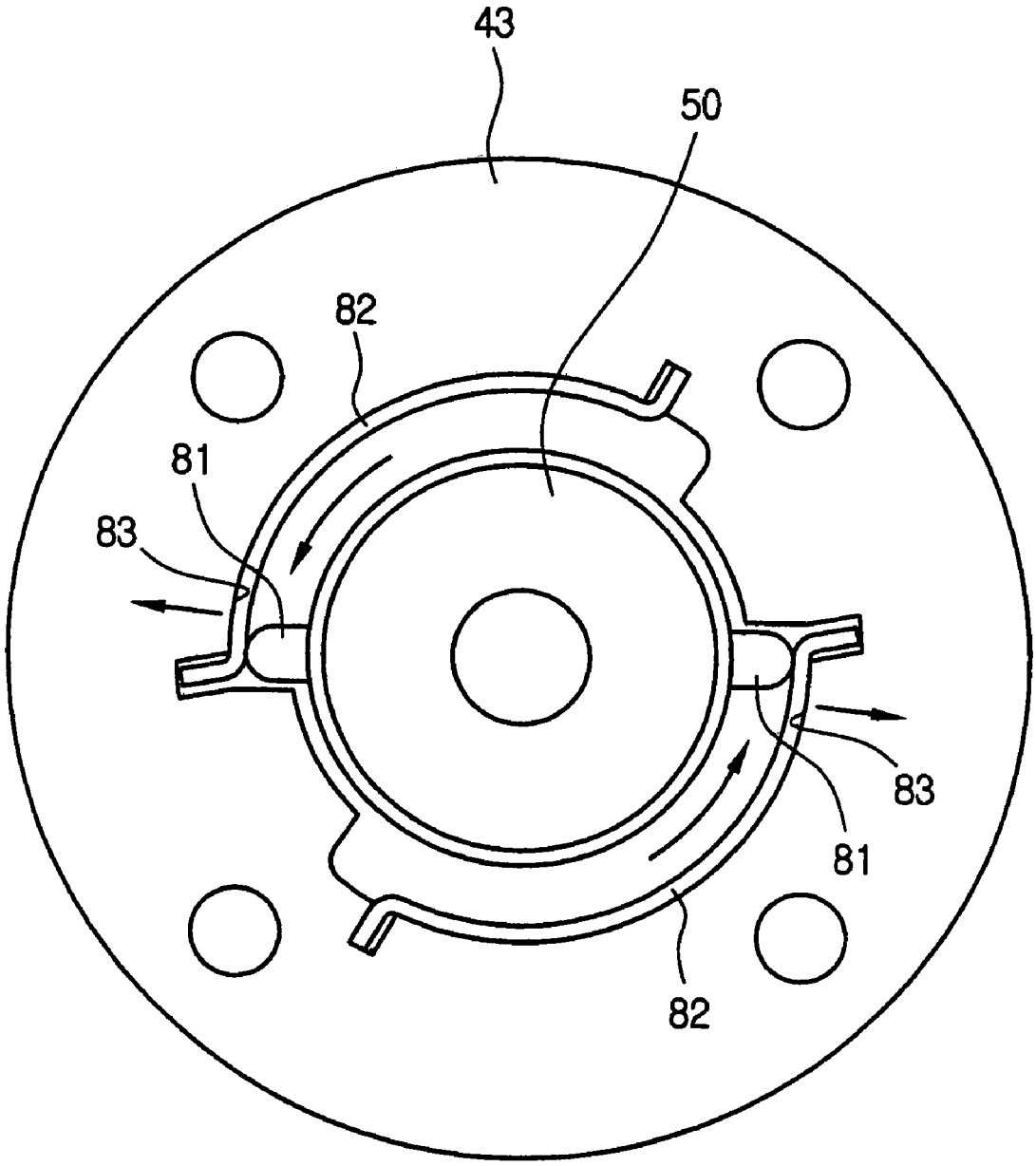
FIG. 9 is a side view showing a first embodiment of a shock-absorbing unit of the hinge device for the storage container, shown in FIG. 3, when the door is closed.

As shown in FIGS. 3 and 9, the shock-absorbing unit 80, which operates to enable the door 20 to smoothly close, includes a pair of protrusions 81 formed on an outer side surface of the support flange 54 of the rotatable hinge shaft 50, and a pair of shock-absorbing springs 82 fitting in an inner circumferential surface of the plug 43, which are provided to increasingly press the pair of protrusions 81 as the door 20 is closed. Each of the pair of shock-absorbing springs 82 includes an arch leaf spring. The inner circumferential surface of the plug 43 is formed with a pair of spring grooves 83 arranged to opposeeach other, so as to allow the pair of shock-absorbing springs 82 to be accommodated and retained therein while allowing the protrusions 81 of the rotatable hinge shaft 50 to rotate therealong. The pair of shock-absorbing springs 82 are installed in the spring grooves 83 to partially move. More specifically, ends of the shock-absorbing springs 82, at which the protrusions 81 are located when the door 20 is opened, are fixedly fitted in the spring grooves 83 to be spaced apart from the protrusions 81 at a time of an opening of the door 20, and other ends of the shock-absorbing springs 82, at which the protrusions 81 are located when the door 20 is closed, are movably received in the spring grooves 83 to be in contact with the protrusions 81 and to inwardly bias the shock-absorbing springs 82 at a time of a closing of the door 20. Accordingly, since the protrusions 81 are pushed by the shock-absorbing springs 82 and thus the rotatable hinge shaft 50 is subjected to a resistance to the rotation thereof when the door 20 rotates in a direction of being closed, the door 20 is smoothly closable without a generation of a shock.

Figure 11:
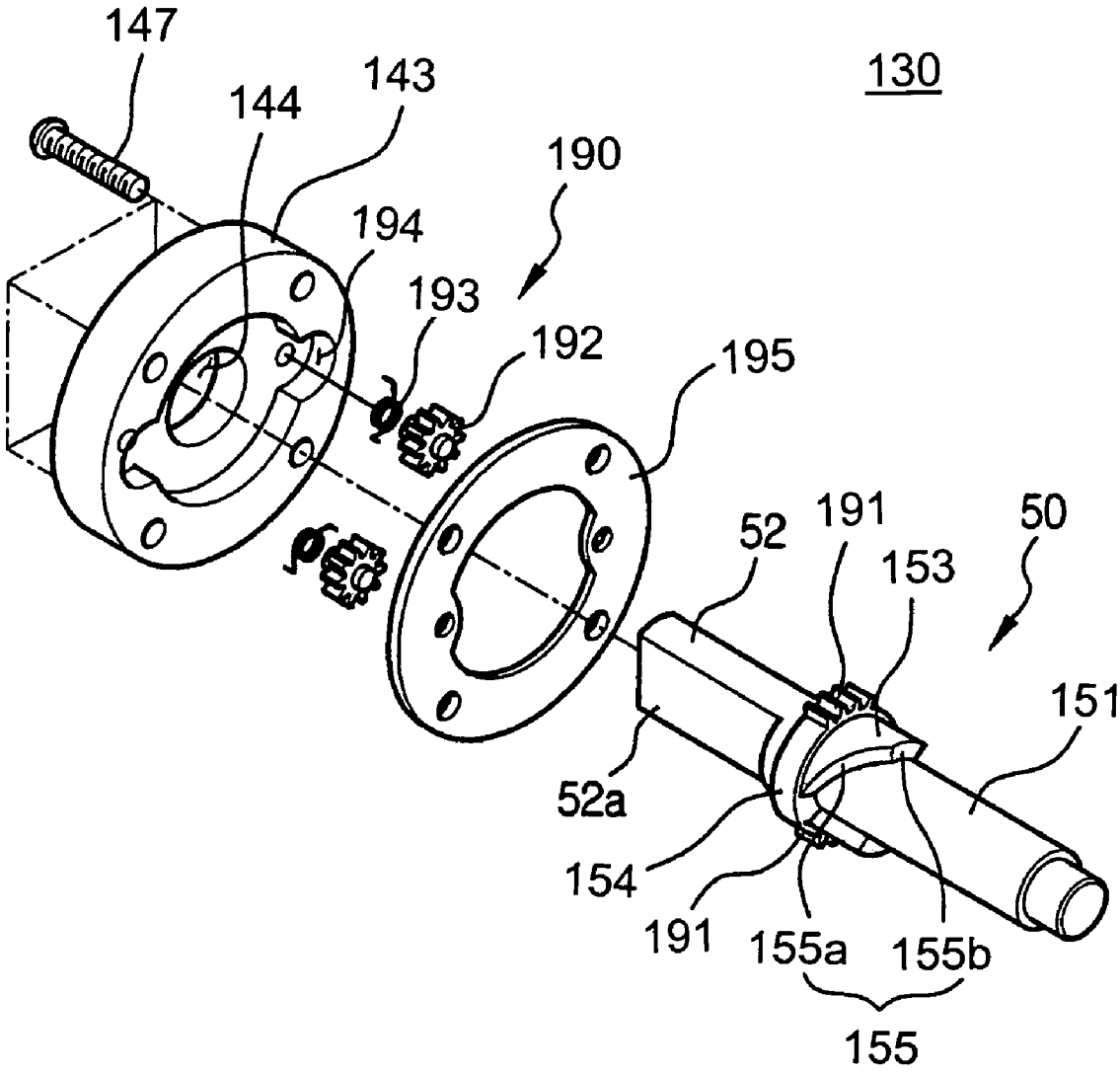
FIG. 11 is an exploded perspective view showing a second embodiment of a shock-absorbing unit of the hinge device for the storage container, according to the present invention.
Figure 12:
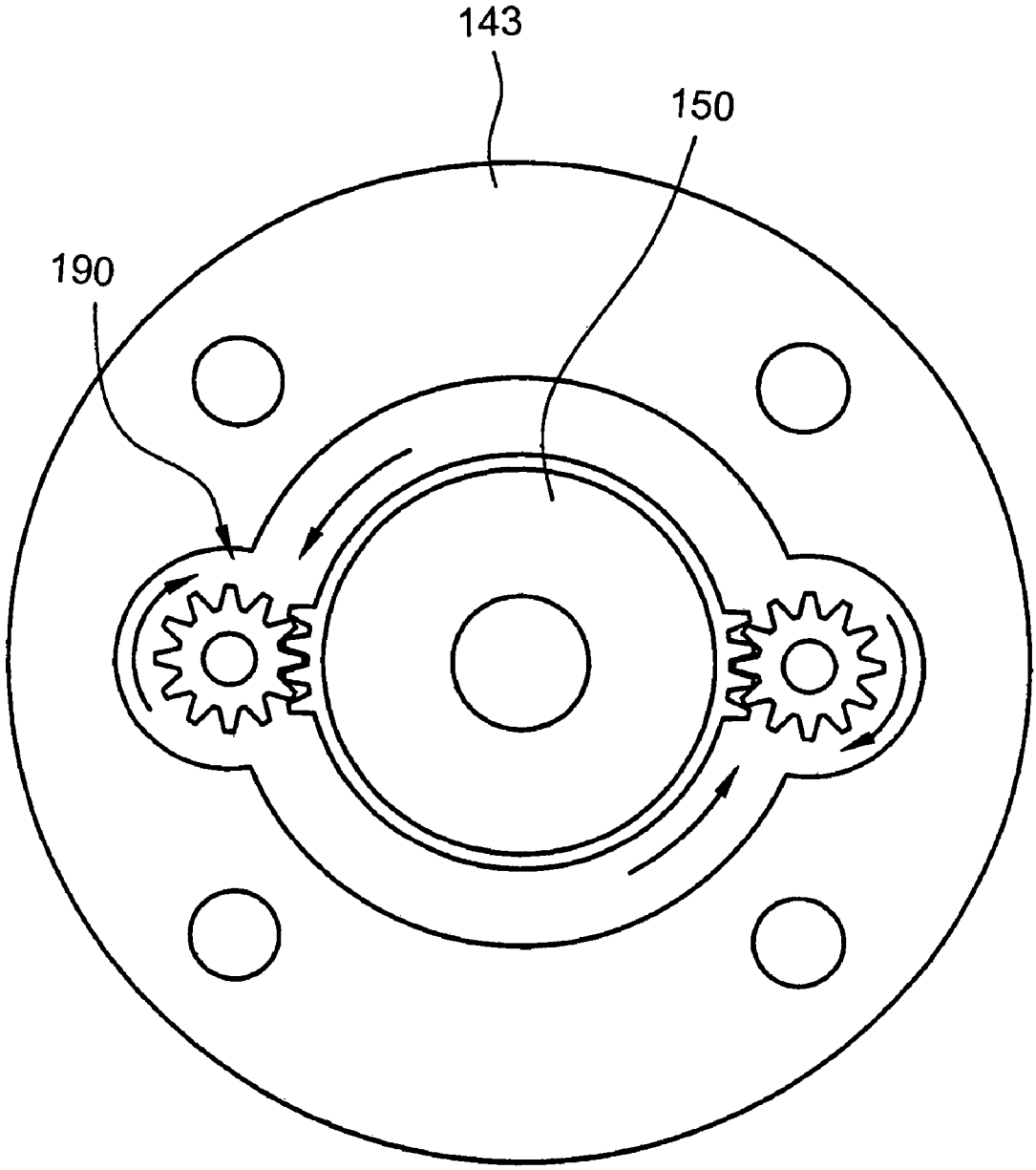
FIG. 12 is a side view showing the second embodiment of the shock-absorbing unit of the hinge device for the storage container, shown in FIG. 11, when the door is closed.
Figure 13:
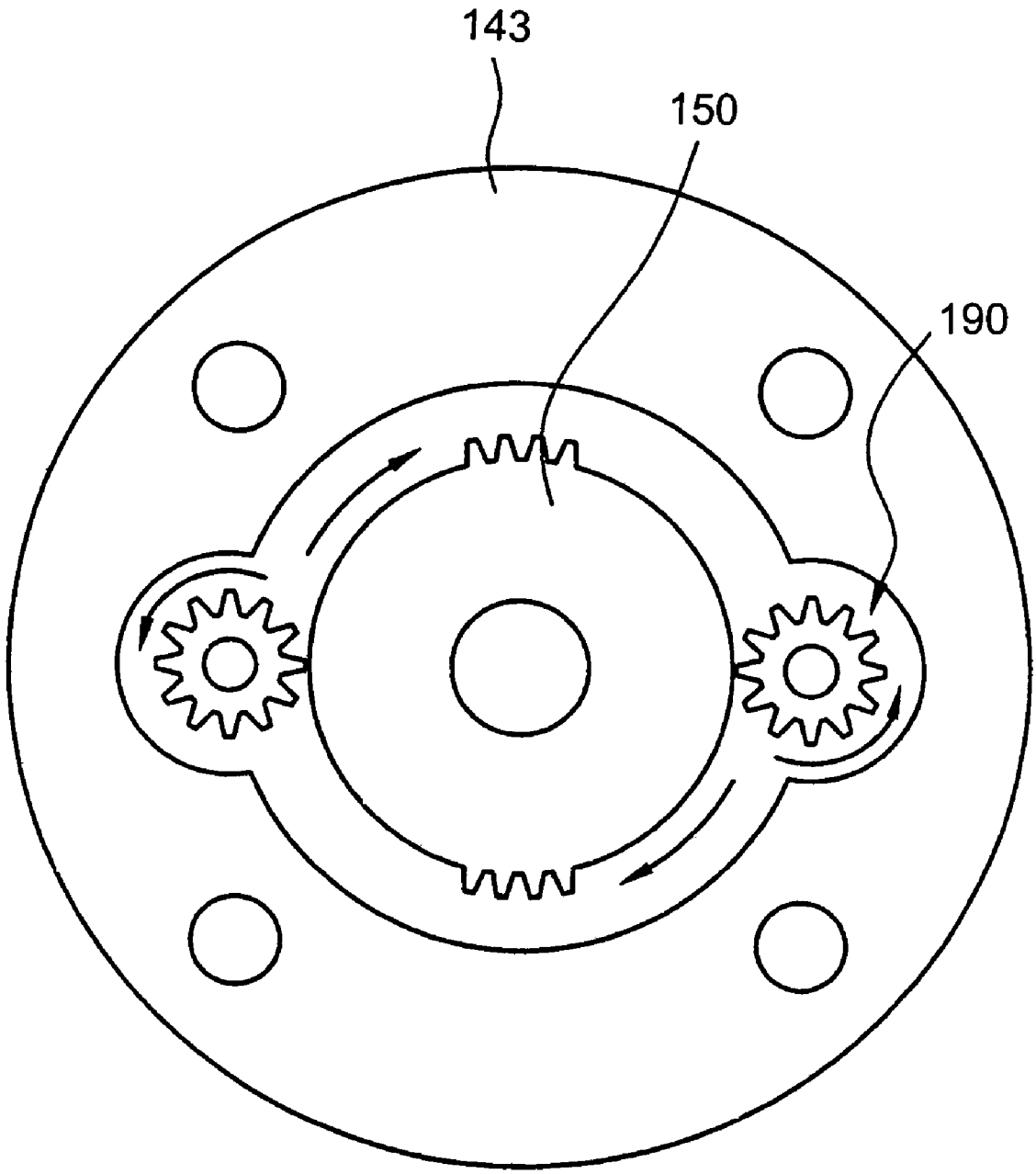
FIG. 13 is a side view showing the second embodiment of the shock-absorbing unit of the hinge device for the storage container, shown in FIG. 11, when the door is opened.

FIGS. 11 through 13 show a second embodiment of a shock-absorbing unit 190 included in the hinge device 130 according to the present invention. The shock-absorbing unit 90 includes a pair of teeth portions 191, which is formed on predetermined areas of an outer side surface of the support flange 154 of the rotatable hinge shaft 150 to be positioned at diametrical opposite sides of the support flange 154, and a pair of gears 192 provided at diametrical opposite sides of an inner circumferential surface of the plug 143. The pair of gears 192 are positioned such that the pair of gears 192 rotate while engaging with the pair of teeth portions 191 when the teeth portions 191 rotate in the closing direction of the door 20. A pair of torsion springs 193 fit on shafts of the pair of gears 192, respectively, so as to resist a rotation of the pair of gear 192. The plug 143 includes a pair of recesses 194 formed on the inner circumferential surface of the plug 143 to accommodate the torsion springs 193 and the gears 192. A retaining plate 195 is provided at an inner side of the plug 143 to rotatably support the shafts of the gears 192. The retaining plate 195 is attached to the housing body 41 together with the plug 143 by set screws 147. When the rotatable hinge shaft 150 rotates in the closing direction of the door 20, the teeth portions 191 engage with the pair of gears 192 equipped with the torsion springs 193, as shown in FIG. 12. Thus, since a rotation of the rotatable hinge shaft 150 is resisted, the door 20 is smoothly closable without the generation of the shock.

Operations of the rotatable hinge shaft device 50 or 150 for a storage container, will now be described.

When a user opens or closes the door 20 of the storage container, the hinge shaft 50 or 150 fitting in the door 20 rotates together with the door 20, and thus the first cam 53 or 153 is provided at the cam shaft part 51 or 151 is also rotated together with the rotatable hinge shaft 50 or 150. At this point, since the movable member 60 is biased toward the first cam 53 or 153 by the compression spring 70, and the second cam 62 of the movable member 60 is in contact with the first cam 53 or 153, the second cam 62 of the movable member 60 is outwardly or inwardly moved while being pressed by the first cam 53 or 153 of the rotatable hinge shaft 50 or 150, when the rotatable hinge shaft 50 or 150 rotates (as the door is opened or closed). On the contrary, since the rotatable hinge shaft 50 or 150 rotates by the second cam 62 moving along the housing body 41 by the compression spring 70, the door 20 is easily opened and closed. That is, since the rotatable hinge shaft 50 or 150 tends to rotate in the opening direction of the door 20 when the door 20 of the storage container is positioned in an "opening section," for example, as shown in FIG. 2, and the rotatable hinge shaft 50 or 150 tends to rotate in the closing direction of the door 20 when the door 20 of the storage container is positioned in a "closing section," for example, as shown in FIG. 2, the door 20 is opened and closed with ease.

More specifically, when the door 20 rotates beyond a predetermined angle and thus is positioned in the "opening section", the inclined opening-guide surfaces 64*a* of the second cam 62 are in contact with the inclined opening-guide surfaces 55*a* or 155*a* of the first cam 53 or 153, as shown, for example, in FIGS. 4 and 7. At this point, since the second cam 62 of the movable member 60 is biased toward the first cam 53 or 153 by the compression spring 70, and pushes the first cam 53 or 153, the rotatable hinge shaft 50 or 150 is subjected to a force tending to rotate the rotatable hinge shaft 50 or 150 in the opening direction of the door 20, thereby facilitating the opening of the door 20. In the "opening section", if the force, which causes the rotatable hinge shaft 50 or 150 to rotate in the opening direction of the door 20 is controlled to be equal to a weight of the door, the door 20 may be maintained in a still (i.e. non-moving) position in the "opening section".

Figure 5:
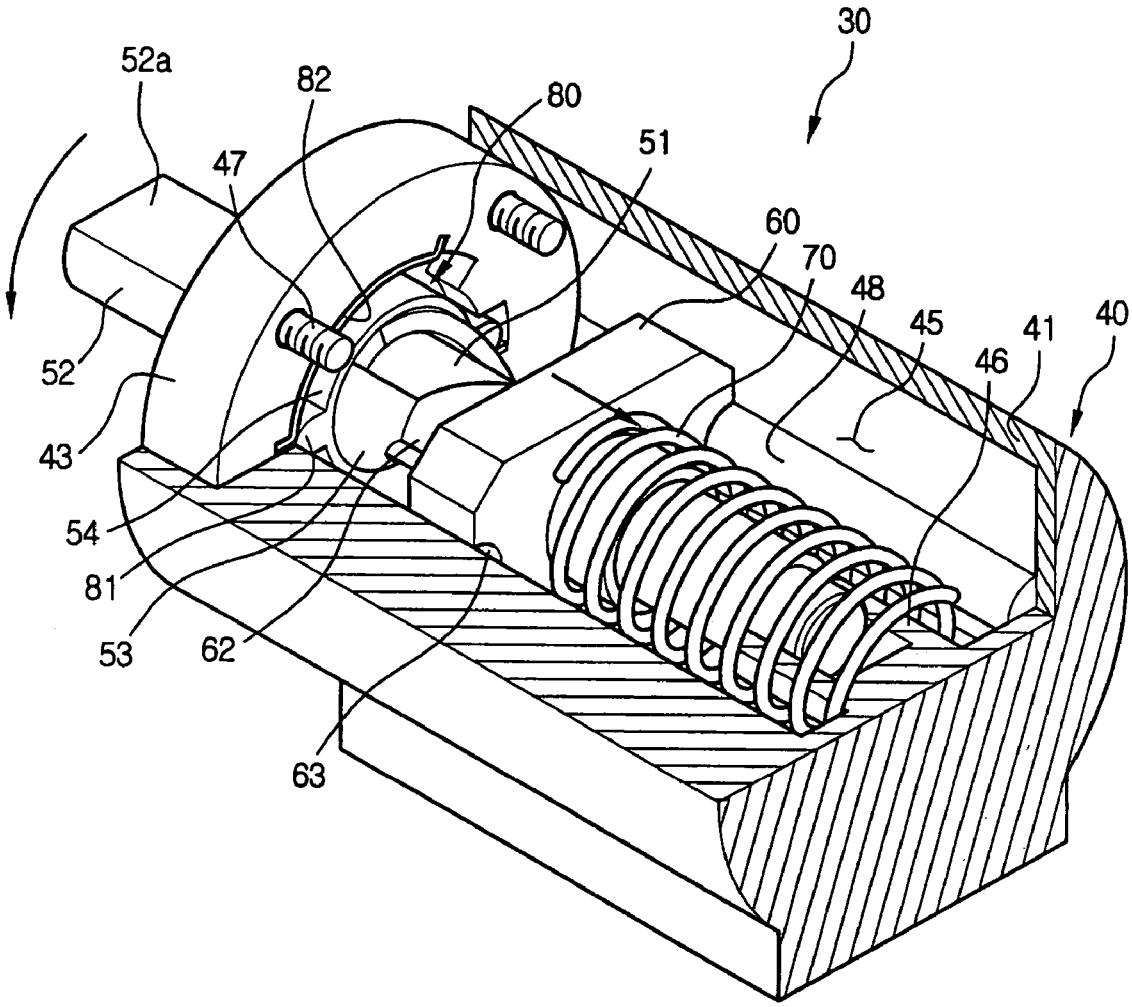
FIG. 5 is a perspective view, which is partially broken away, of the assembled hinge device shown in FIG. 3 when closing the door.

When the door 20 rotates below the predetermined angle and is positioned in the "closing section", the closing-guide surfaces 64*b* of the second cam 62 are in contact with the closing-guide surfaces 55*b* or 155*b* of the first cam 53 or 153, as shown, for example, in FIGS. 5 and 8. At this point, since the closing-guide surfaces 64*b* of the second cam 62 and the closing-guide surfaces 55*b* or 155*b* of the first cam 53 or 153 are formed perpendicular to the axis of the rotatable hinge shaft 50 or 150 without an inclination thereof, the force from the movable member 60, which is generated by the elasticity of the compression spring 70, no longer affects the rotation of the rotatable hinge shaft 50 or 150. Accordingly, when the door 20 is positioned in the "closing section", the door 20 rotates in the closing direction by the weight thereof, and is thus automatically closed.

Further, for the first embodiment of the shock absorbing unit 80, when the door 20 rotates to be near a completely closed point, the door 20 is smoothly closed without the shock, by the shock-absorbing unit 80. That is, when the door 20 is closing, the door smoothly closes without the shock because the protrusions 81 of the rotatable hinge shaft 50 are pressed by the shock-absorbing springs 82 and the rotatable hinge shaft 50 is subjected to the resistance to the rotation, as shown in FIG. 9.

Figure 10:
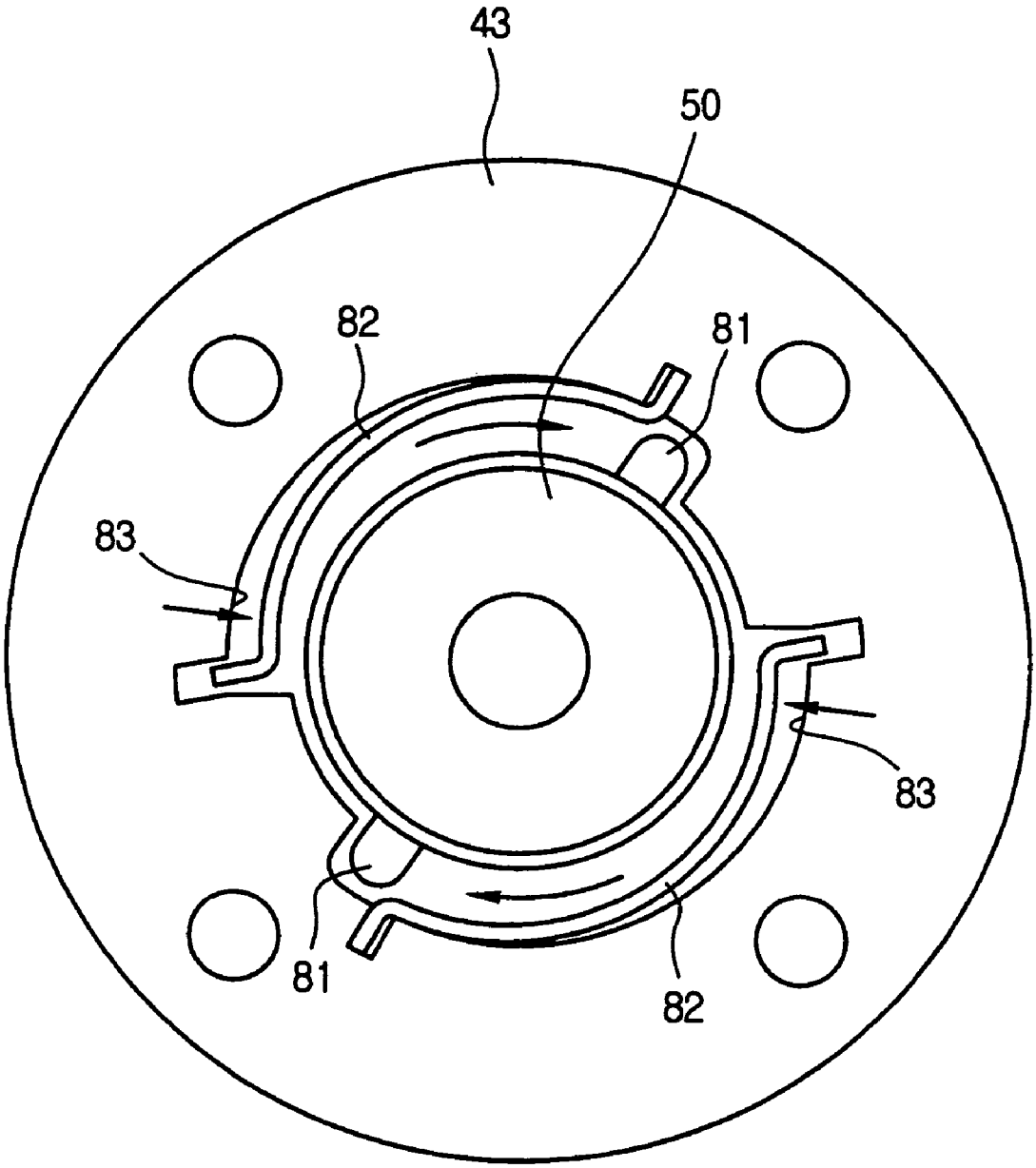
FIG. 10 is a side view showing the embodiment of the shock-absorbing unit of the hinge device for the storage container, shown in FIG. 3, when the door is opened.

When the door 20 is opened, the protrusions 81 are released from an engagement with the shock-absorbing springs 82, and then the shock-absorbing springs 82 are restored to rest positions thereof due to an elasticity thereof, as shown in FIG. 10. Therefore, when the door 20 is closed again, the door 20 is subjected to a cushioning action because the protrusions 81 slide on the shock-absorbing springs 82 while pushing the shock-absorbing springs 82 outwardly.

The second embodiment shown in FIG. 11, in which the shock-absorbing unit 90 comprises the teeth portions 191, the gears 192 and the torsion springs 193, is described hereinafter.

When the door 20 is positioned near the completely closed position, the teeth portions 191 of the rotatable hinge shaft 150 begin to engage with the gears 192, thereby causing the gears 192 to rotate, as shown in FIG. 12. At this point, since a rotation of the gears 192 is restrained by the torsion springs 193 serving as a resisting source, the rotatable hinge shaft 150 is subjected to a resistance through the teeth portions 191, thereby allowing the door 20 to smoothly close without the shock.

When the door 20 is opened, the teeth portions 191 are released from the engagement with the gears 192, as shown in FIG. 13. At this time, since the gears 192 rotate in a reverse direction by the torsion springs 193 and are restored to rest positions thereof, the gears 192 operate to absorb the shock when the door 20 is later closed.

As is apparent from the above description, a hinge device for a storage container is provided, which is constructed into a single unit, unlike that of a conventional hinge device comprising two or more units. Accordingly, since the hinge device is constructed by a reduced number of components, compared to that of the conventional hinge device, an operation of coupling a door to a container body is simplified, and thus manufacturing costs thereof are reduced.

Further, since a hinge shaft of the hinge device is subjected to a resistance to a rotation by a cushioning action of a shock-absorbing unit, the door smoothly closes, thereby preventing a generation of the shock.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A hinge device for a storage container, which enables a door of the container to swingably couple to a container body, the hinge device comprising:

a housing mounted on any one of the door and the container body;

a pair of hinge shafts rotatably fitting in respective ends of the housing, each of the pair of hinge shafts including a respective one of a pair of cam shaft parts with a respective one of a pair of first cams provided on an outer circumferential surface of the respective one of the pair of cam shaft parts, and a respective one of a pair of extension shaft parts outwardly extending from the respective one of the pair of cam shaft parts to couple to a remaining one of the door and the container body;

a pair of movable members, which are received in the respective ends of the housing and fit on the cam shaft parts of respective ones of the pair of hinge shafts so as not to rotate with respect to the housing, each of the pair of movable members having a respective one of a pair of second cams to engage with the respective one of the first pair of first cams; and a pair of compression springs disposed in the respective ends of the housing to bias the pair of movable members toward the pair of first cams, respectively.

2. The hinge device for a storage container as set forth in claim 1, wherein the housing includes a housing body, which is opened at respective ends thereof and receives the pair of movable members and the pair of compression springs in the respective opened ends of the housing body, and a pair of plugs coupled to the respective opened ends of the housing body, each of the pair of plugs having a respective one of a pair of shaft holes, through which an extension shaft part of the respective one of the pair of hinge shaft passes.

3. The hinge device for a storage container as set forth in claim 2, wherein:

the housing body comprises a guide rail longitudinally provided on an inner surface of the housing body to assure a stable movement of each of the movable members in the housing body while preventing a rotation of each the movable members, and each of the pair of movable members comprises a guide groove corresponding to the guide rail of the housing body.

4. The hinge device for a storage container as set forth in claim 1, wherein one of the first cams and one of the second cams facing the one first cam of each of the hinge shafts, include tooth-shaped cam surfaces corresponding to each other, each of the cam surfaces having an opening-guide surface inclined with respect to an axis of the respective one of the pair of hinge shafts, so as to cause each of the hinge shafts to rotate in an opening direction of the door when the door is opened, and a closing-guide surface perpendicular to the axis of the respective one of the pair of hinge shafts, so as to allow the respective one of the pair of hinge shafts to rotate in a closing direction of the door by a weight of the door when the door is being closed.

5. The hinge device for a storage container as set forth in claim 2, further comprising:

a shock-absorbing unit to increase a resistance to a rotation of each of the hinge shafts when the door is being closed, the shock-absorbing unit including a protrusion provided on an outer surface of each of the hinge shafts and disposed in an inner circumferential surface of each of the plugs, and a shock-absorbing spring attached to the inner circumferential surface of each of the plugs and disposed outside of a respective one of the protrusions, so as to press the respective one of the protrusions when the door is being closed.

6. The hinge device for a storage container as set forth in claim 5, wherein each of the shock-absorbing springs comprises an arch leaf spring.

7. The hinge device for a storage container as set forth in claim 2, further comprising a shock-absorbing unit to increase a resistance to a rotation of each of the hinge shafts when the door is being closed, the shock-absorbing unit including a teeth portion provided on an outer surface of each of the hinge shafts and disposed in an inner circumferential surface of each of the plugs, a gear rotatably held on the inner circumferential surface of each of the plugs, so as to engage with a respective one of the teeth portions when the door rotates to an almost closed position, and a torsion spring disposed on a shaft of each of the gears to provide each of the gears with the resistance to the rotation.

8. The hinge device for a storage container as set forth in claim 1, further comprising a shock-absorbing unit to increase a resistance to a rotation of each of the hinge shafts when the door is being closed.

9. The hinge device for a storage container as set forth in claim 8, wherein the shock-absorbing unit includes a protrusion provided on an outer surface of each of the hinge shafts and disposed in an inner circumferential surface of each of the plugs, and a shock-absorbing spring attached to the inner circumferential surface of each of the plugs and disposed outside of a respective one of the protrusions, so as to press the respective one of protrusions when the door is being closed.

10. The hinge device for a storage container as set forth in claim 8, wherein the shock-absorbing unit includes a teeth portion provided on an outer surface of each of the hinge shafts and disposed in an inner circumferential surface of each of the plugs, a gear rotatably supported on the inner circumferential surface of each of the plugs, so as to engage with a respective one of the teeth portions when the door rotates to be near a completely closed position, and a torsion spring disposed on a shaft of each of the gears to provide each of the gears with a resistance to a rotation.

11. A hinge device for a storage container, which enables a door of the storage container to swingably couple to a container body, the hinge device comprising:

a housing mounted on any one of the door and the container body;

a hinge shaft rotatably fitting at one end thereof in an end of the housing, and outwardly extending at a remaining end thereof from the housing to couple to a remaining one of the door and the container body; and a shock-absorbing unit provided between an inner surface of the housing and an outer surface of the hinge shaft such that a portion of the shock-absorbing unit is formed on the outer surface of the hinge shaft, so as to increase a resistance to a rotation of the hinge shaft when the door is being closed.

12. The hinge device for a storage container as set forth in claim 11, wherein the shock-absorbing unit includes a protrusion provided on the outer surface of the hinge shaft, and a shock-absorbing spring attached to the inner surface of the housing and disposed outside of the protrusion, so as to press the protrusion when the door is being closed.

13. The hinge device for a storage container as set forth in claim 11, wherein the shock-absorbing unit includes a teeth portion provided on the outer surface of the hinge shaft, a gear rotatably supported on the inner surface of the housing, so as to engage with the teeth portion when the door rotates near a completely closed position, and a torsion spring disposed on a shaft of the gear to provide the gear with the resistance to the rotation.

14. A storage container including a container body having a storage chamber with a top thereof being opened, a door to close the container body, and a hinge device to enable the door to swingably couple to the container body, the hinge device comprising:

a housing mounted on any one of the door and the container body;

a pair of hinge shafts rotatably fitting in opposite ends of the housing, the pair of hinge shafts including cam shaft parts with first cams provided on outer circumferential surfaces of the cam shaft parts, respectively, and extension shaft parts outwardly extending from the cam shaft parts, respectively, to coupled to a remaining one of the door and the container body;

a pair of movable members, which are received in the opposite ends of the housing, and fitting on the cam shaft parts of the hinge shafts, respectively, so as not to rotate with respect to the housing, the pair of movable members having second cams to engage with the first cams, respectively; and a pair of compression springs disposed in the opposite ends of the housing to bias the pair of movable members toward the pair of first cams, respectively.

15. A storage container including a container body having a storage chamber with a top thereof being opened, a door to close the container body, and a hinge device to enable the door to swingably couple to the container body, the hinge device comprising:

a housing mounted on any one of the door and the container body;

a hinge shaft rotatably fitting at one end thereof in an end of the housing, and outwardly extending at another end thereof from the housing to couple to a remaining one of the door and the container body; and a shock-absorbing unit provided between an inner surface of the housing and an outer surface of the hinge shaft such that a portion of the shock-absorbing unit is formed on the outer surface of the hinge shaft, so as to increase a resistance to a rotation of the hinge shaft when the door is being closed.

16. The storage container as set forth in claim 15, wherein the shock-absorbing unit includes a protrusion provided on the outer surface of the hinge shaft, and a shock-absorbing spring attached to the inner surface of the housing and disposed outside of the protrusion, so as to press the protrusion when the door is being closed.

17. The storage container as set forth in claim 15, wherein the shock-absorbing unit includes a teeth portion provided on the outer surface of the hinge shaft, a gear rotatably supported on the inner surface of the housing, so as to engage with the teeth portion when the door rotates near a completely closed position, and a torsion spring disposed on a shaft of the gear to provide the gear with the resistance to the rotation.

18. A hinge device to rotatably couple a door to a main body, comprising:

a housing mounted on any one of the door and the main body;

plural hinge shafts rotatably fitting in respective ends of the housing, each of the hinge shafts including a cam shaft part with a first cam provided thereon, and a respective extension shaft part extending from the cam shaft part, to couple to a remaining one of the door and the main body;

plural movable members, received in the respective ends of the housing and fitting on the cam shaft parts of respective ones of the hinge shafts so as not to rotate with respect to the housing, each of the movable members having a second cam, to engage with a respective one of the first cams; and plural compression springs disposed in the respective ends of the housing to bias the plural movable members toward the plural first cams, respectively.

19. The hinge device as set forth in claim 18, wherein the first and second cams comprise:

cam surfaces, respectively, shaped into a mating sawteeth form, such that the cam surfaces of the first and second cams are engagable with each other.

20. The hinge device as set forth in claim 19, wherein the first and second cams surfaces comprise:

inclined opening-guide surfaces, respectively, and are formed over a predetermined section thereof such that when the door is opened by a predetermined angle or more than the predetermined angle, respective ones of the rotatable hinge shafts fitting in the door are forced to rotate in a direction of an opening of the door by elasticity of respective ones of the compression springs.

21. The hinge device as set forth in claim 18, wherein the hinge device is constructed in a single constructional unit.

22. The hinge device as set forth in claim 18, wherein the plural hinge shafts, the plural movable members, and the plural compression springs are symmetrically provided at respective ends of the housing.

23. The hinge device as set forth in claim 18, wherein the housing includes a housing body and comprises:

reception spaces formed in the housing body at ends thereof; and plugs filling in openings formed in the housing body, wherein:

each of the plugs closes a respective one of the reception spaces, each of the reception spaces receives one of the plural hinge shafts, one of the plural movable members and one of the plural compression springs, each of the plugs is formed with a shaft hole through which one of the hinge shafts passes, and each of the reception spaces has a substantially rectangular section to permit a respective one of the movable members to longitudinally move in the respective one of the reception spaces while preventing a rotation of the respective one of the movable members.

24. The hinge device as set forth in claim 18, wherein each extension shaft part is integrally formed with a respective one of the cam shaft parts, and outwardly extends from the housing by a predetermined distance.

25. The hinge device as set forth in claim 23, wherein the hinge device further comprises:

a shock-absorbing unit to enable the door to smoothly close, and comprises:

a pair of protrusions formed on an outer surface of each of the plural hinge shafts, and a pair of shock-absorbing members fitting in an inner circumferential surface of each of the plugs, which are provided to increasingly press the pair of protrusions as the door is being closed.

26. A hinge device to rotatably couple a door to a main body, comprising:

a housing mounted on any one of the door and the main body;

plural hinge shafts rotatably fitting in respective ends of the housing, each of the hinge shafts including a first cam unit thereon with an extension shaft part to couple to a remaining one of the door and the main body;

plural movable members, received in the respective ends of the housing and coupling to a cam unit of a respective one of the hinge shafts so as to allow the movable members to longitudinally move while preventing a rotation of the movable members with respect to the housing, each of the movable members having a second cam unit to engage with a respective first cam unit; and plural compression units disposed adjacent to the movable member, to bias the plural movable members toward respective first cams, respectively.

27. A storage container, comprising:

a container body having a storage chamber with a top thereof being opened;

a door to close the container body; and a hinge device to enable the door to rotatably couple to the container body, wherein the hinge device comprises:

a housing mounted on any one of the door and the main body;

plural hinge shafts rotatably fitting in respective ends of the housing, each of the hinge shafts including a cam shaft part with a first cam provided thereon, and a respective extension shaft part extending from the cam shaft part to couple to a remaining one of the door and the container body;

plural movable members, received in the respective ends of the housing and fitting on the cam shaft parts of respective ones of the hinge shafts so as not to rotate with respect to the housing, each of the movable members having a second cam to engage with a respective one of the first cams; and plural compression springs disposed in the respective ends of the housing to bias the plural movable members toward the plural first cams, respectively.

28. The storage container as set forth in claim 27, wherein the first and second cams comprise:

cam surfaces, respectively, shaped into a mating sawteeth form, such that the cam surfaces of the first and second cams are engagable with each other.

29. The storage container as set forth in claim 23, wherein the hinge device further comprises:

a shock-absorbing unit to enable the door to smoothly close, and comprises:

a pair of protrusions formed on an outer surface of each of the plural hinge shafts, and a pair of shock-absorbing members fitting in an inner circumferential surface of each of the plugs, which are provided to increasingly press the pair of protrusions as the door is being closed.

30. A storage container, comprising:

a container body having a storage chamber with a top thereof being opened;

a door to close the container body; and a hinge device to enable the door to rotatably couple to the container body, wherein the hinge device comprises:

a housing mounted on any one of the door and the main body, plural hinge shafts rotatably fitting in respective ends of the housing, each of the hinge shafts including a first cam unit thereon with an extension shaft part, to couple to a remaining one of the door and the main body, plural movable members, received in the respective ends of the housing and coupling to a cam unit of a respective one of the hinge shafts so as to allow the movable members to longitudinally move while preventing a rotation of the movable members with respect to the housing, each of the movable members having a second cam unit to engage with a respective first cam unit, and plural compression units disposed adjacent to the movable member, to bias the plural movable members toward respective first cams, respectively.

* * * * *

UNITED STATES PATENT AND TRADEMARK OFFICE

CERTIFICATE OF CORRECTION

PATENT NO. : 7,350,664 B2
APPLICATION NO. : 10/793239
DATED : April 1, 2008
INVENTOR(S) : Jeong Man Nam et al.

It is certified that error appears in the above-identified patent and that said Letters Patent is hereby corrected as shown below:

Title Page, Item [57] Column 2 (Abstract), Line 1, change “containerand” to --container and--.

Column 10, Line 9 claim 3, after “each” insert --of--.

Column 13, Line 1 claim 23, change “filling” to --fitting--.

Signed and Sealed this

Twenty-sixth Day of August, 2008

JON W. DUDAS
*Director of the United States Patent and Trademark Office*